US005412824A

United States Patent [19]

Emerson et al.

[11] Patent Number: 5,412,824

[45] Date of Patent: May 9, 1995

[54] EXPANDABLE SUPPORT MATTRESS, PARTICULARLY TO SUPPORT WOMEN DURING PREGNANCY

[75] Inventors: Mark D. Emerson; Matt H. Emerson; David D. Emerson, all of San Jose, Calif.

[73] Assignee: Maternal Concepts, Ltd., San Jose, Calif.

[21] Appl. No.: 105,123

[22] Filed: Aug. 12, 1993

[51] Int. Cl.[6] ..... A47C 27/10; A61G 7/00

[52] U.S. Cl. ..... 5/632; 5/631; 5/454; 5/930

[58] Field of Search ..... 5/930, 631, 632, 453, 5/454, 455, 462

[56] References Cited

U.S. PATENT DOCUMENTS

| | | | |
|---|---|---|---|
| 2,182,861 | 12/1939 | Albert | 5/462 |
| 3,988,793 | 11/1976 | Abitol | 5/930 |
| 4,054,960 | 10/1977 | Pettit et al. | 5/930 |
| 4,382,306 | 5/1983 | Lickert | 5/930 |
| 4,737,999 | 4/1988 | Halverson | 5/930 |
| 4,944,059 | 7/1990 | Wall | 5/930 |
| 4,984,315 | 1/1991 | Ortman et al. | 5/631 |
| 5,185,897 | 2/1993 | Van Laanen | 5/930 |

FOREIGN PATENT DOCUMENTS

| | | | |
|---|---|---|---|
| 2826074 | 12/1979 | Germany | 5/631 |

*Primary Examiner*—Alexander Grosz

[57] ABSTRACT

An adjustable mattress, adapted to support a substantial portion, including the breasts, abdomen, hips, thighs and knees of the body of a pregnant female user in a prone position, comprising a generally horizontal upper mattress portion with a first cavity adapted to accommodate the enlarged abdomen of the user and a second, adjustable in size, cavity adapted to accommodate the breasts of the user, and a lower mattress portion adapted to support the thighs and knees of the user, the lower mattress portion having a supporting surface sloping downwardly from the upper mattress position adjacent the hip supporting area towards the knee supporting area of the lower mattress portion, the downwardly sloped lower mattress portion adapted to support the thighs in a downwardly inclined orientation and to facilitate the getting on or off the mattress by the user.

7 Claims, 5 Drawing Sheets

EXPANDABLE SUPPORT MATTRESS, PARTICULARLY TO SUPPORT WOMEN DURING PREGNANCY

BACKGROUND—FIELD OF THE INVENTION

This device relates to expandable mattresses, specifically those having a plurality of independently-expandable chambers.

BACKGROUND—DESCRIPTION OF PRIOR ART

Many modifications to conventional mattresses have been patented to accomodate the shape of a woman's pregnant body while lying in the recumbent position. While these inventors have yet to see any of these designs commercially available, many of these attempts deserve attention.

U.S. Pat. No. 3,840,920 issued to Walter Voelker (1974) describes a mattress containing a varying amount of flowable material that can be shifted from one part of the mattress to another by altering the pressure in the different parts of the mattress. While this helps to support the pregnant form to a certain degree, there is still a lack of total accomodation for the pregnant form. Also, the use of lubricants, beads and other materials as described would add greatly to the weight of the device and could also raise the manufacturing costs.

U.S. Pat. No. 3,988,793 issued to Maurice Abitbol (1976) describes a device for preventing and treating toxemia in pregnant women, consisting of a mattress with a chamber open at the top and surrounded by an inflatable ring for receiving the pregnant abdomen. In this fashion, an enclosed chamber is formed which, connected to a vacuum pump providing negative pressure, relieves the stress of the pregnant uterus on the abdominal aorta. This device would be cumbersome and costly to manufacture, due to the necessary purchase of a vacuum pump. The abdominal area must be naked in order to form a perfect seal with the chamber, a potentially uncomfortable prospect for its user. Finally, letting gravity take its course would relieve any stress on the abdominal aorta without the need for negative pressure.

U.S. Pat. No. 4,054,960 issued to John and Dorothy Pettit (1977) describes an inflatable cushion with a circular opening passing through the center of the cushion to surround and partially support the pregnant abdomen. The depth and softness of this opening is increased or decreased through a valve mechanism during progressive stages of the pregnancy. A separate, inflatable plug is provided to fill the central cushion opening, adapting the cushion for use as a conventional air mattress after pregnancy. While simple to manufacture, this device lacks multiple chambers and when inflated to full pressure could restrict the size of the opening and put an uncomfortable level of stress on the pregnant abdomen.

U.S. Pat. No. 4,021,872 issued to Lee Powell (1977) describes a mattress consisting of a main opening for the pregnant abdomen and adjustability attained through the addition or removal of a plurality of resilient disc-like members arranged vertically within the opening and below the pregnant abdomen. It is questionable as to whether this would fully conform to the pregnant female form; it is unlikely that them would a complimentary fit between the device and the user during the entire length of pregnancy. In addition, increasing the number of additional parts could prove costly to manufacture and/or transport.

U.S. Pat. No. 4,819,287 issued to Debra Halverson (1989) likewise describes a mattress comprising of a plurality of cushions which are serially arranged within one another and located within the opening of the main mattress section, with at least one of the cushions being noninflatable for enhanced structural support. It is questionable as to whether this device would either completely support the pregnant female form or be cost-effective to manufacture.

Notwithstanding all of the aforementioned prior art or other prior art not mentioned herein, there appears to be ho reference which renders obvious critically integral properties of the present invention. All the maternal support devices heretofore known suffer from a number of disadvantages:

(a) The adjustability of any current device is limited—its ability to fit one particular physique makes it difficult to fit other physiques as well.

(b) The use of additional attachments—ie. rings and/or discs—help the device in its adjustability, but still fall short of completely and comfortably supporting the pregnant female form. These attachments would not adjust precisely during all stages of pregnancy and their manufacture could raise costs through the necessary purchase of additional equipment.

(c) Devices of the current type offer no means for adjustability while laying upon them, a crucial factor for maximum support, comfort and ease of operation.

(d) The ideal situation would have the device placed upon a conventional mattress. With the added height of both the device and the mattress, however, there is considerable concern when getting on or off the device in a traditional side-to-side manner; falling off the device and bed combined could cause serious injury to the woman as well as the fetus.

OBJECTS AND ADVANTAGES

Accordingly, several objects and advantages of the present invention are:

(a) to provide a support device which can be precisely adjusted to conform to the pregnant female form during all stages of pregnancy, thus allowing for a "one size fits all" device and, subsequently, a simplified manufacturing process;

(b) to provide a support device which is all-inclusive; there are no removable attachments that would raise manufacturing costs and could be lost or misplaced during shipment or use;

(c) to provide a support device which can be adjusted while simultaneously laying upon the device itself; and (d) to provide a support device which reduces the possibility of injury from getting on or off the device by providing a front-to-back entry vs. the traditional side-to-side entry.

Further objects and advantages are to provide a support device which can be used either on the floor or on a conventional mattress, which is simple to use, which is made of pre-formed materials and thus more easily manufactured, and which can be used repeatedly, thus lowering consumer costs. Still further objects and advantages will become apparent from a consideration of the ensuing description and drawings.

BRIEF DESCRIPTION OF DRAWINGS

In the drawings, several parts am designated with a number and then the same number with an alphabetical suffix. The parts in each case are identical, with the alphabetical suffix merely designating another possible position of the same part.

Figure 1:
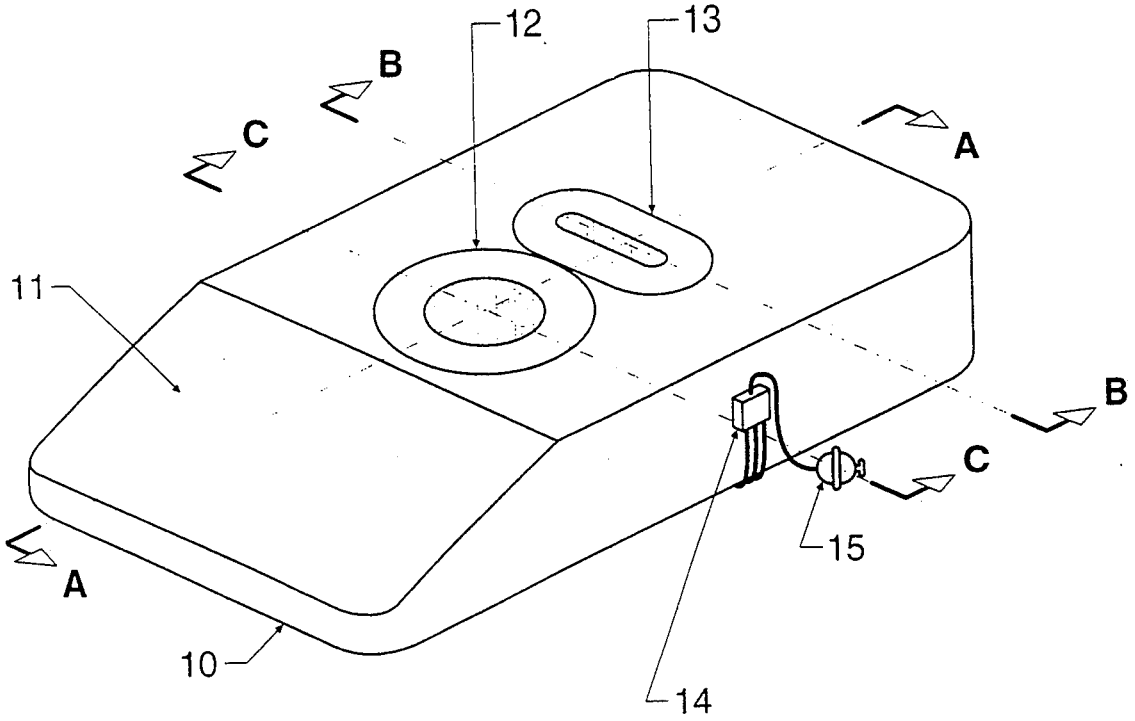
FIG. 1 is an isometric view of a support device of the present invention showing the main mattress body with the integrated receiving chambers for the abdomen and breasts.

FIGS. *7a, 7b* and *7c* are side views, partially in cross section of the support device along line A—A, showing the physical operation of the device. Included in each depiction is the profile of a pregnant woman in various stages of use of the device as well as an optional support device for the feet.

REFERENCE NUMERALS IN DRAWINGS

10 Mattress (all-inclusive)
11 Main mattress chamber (see FIGS. 1, 2)
12 Receiving chamber for the abdomen
13 Receiving chamber for the breasts
14 Adjustment valve for inflation device—selects which chamber is being expanded/contracted by inflation device 15
15 Inflation device for the expandable means within each separate chamber (see FIG. 2)
16/16A Various stages of adjustability of the expandable means within the receiving chamber for the abdomen (see FIGS. 3, 6)
17/17A Various stages of adjustability of the expandable means within the receiving chamber for the breasts (see FIGS. 3, 5)
18 Pregnant female figure (see FIGS. *7a, 7b, 7c*)
19 Additional support device (optional; see FIGS. *7a, 7b, 7c*)

DETAILED DESCRIPTION OF DRAWINGS

Mattress 10 (FIG. 2) has a main mattress section 11 of conventional configuration as shown, but with openings 12 and 13 to receive the abdomen and breasts, respectively, of a pregnant female. While mattress 10 is portrayed in this case as an inflatable mattress having an inflation device 15 and adjustment valve 14, it should be considered that the mattress may be constructed using any pliable material and designed to contain any number of flowable or nonflowable materials. These may include, but are not necessarily limited to, water, foam, air, gases (non-air), or any other form of organic or synthetic filler material such as feathers, beads, etc. Chambers 11, 12 and 13 have an inflation device 15. The inflation device 15 is designed to have sufficient inflating capacity to expand and adjust the respective chambers and of sufficient length to allow the pregnant female to adjust chambers 11, 12 and 13 to a comfortable level while simultaneously laying upon the mattress 10. This inflation device would be similar to manual inflation devices commercially available and would be prefabricated, thus enabling attachment during the manufacturing process.

Figure 2:
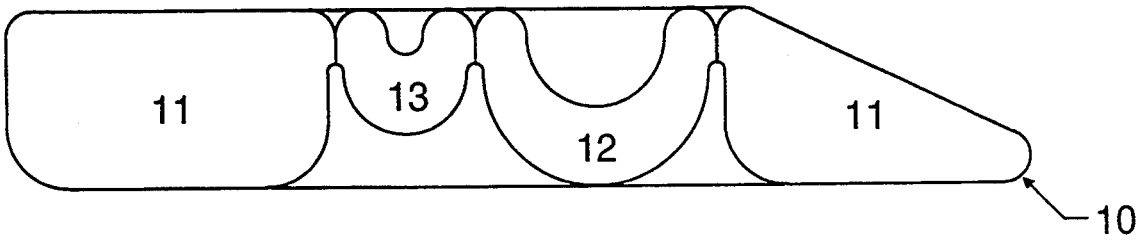
FIG. 2 is a side view, partially in cross section of the support device, showing the three chambers constituting the present invention.

FIG. 2 shows the mattress 10 and its respective components in a side view, partially in cross section along axis A—A. The preferred embodiment would have chambers 11, 12 and 13 expanded to their own particular volume to support their respective regions of the pregnant female body. At the early stages of pregnancy at which the pregnant female abdomen begins to expand to accomodate the fetus (16–20 weeks), chambers 12 and 13 of mattress 10 can be expanded almost to the support level of a conventional mattress. Equally important is the slope as depicted here. In the preferred embodiment the slope is designed to help the pregnant female get on and off the mattress 10 in a top-to-bottom fashion, replacing the more conventional side to side entry/exit.

Figure 4:
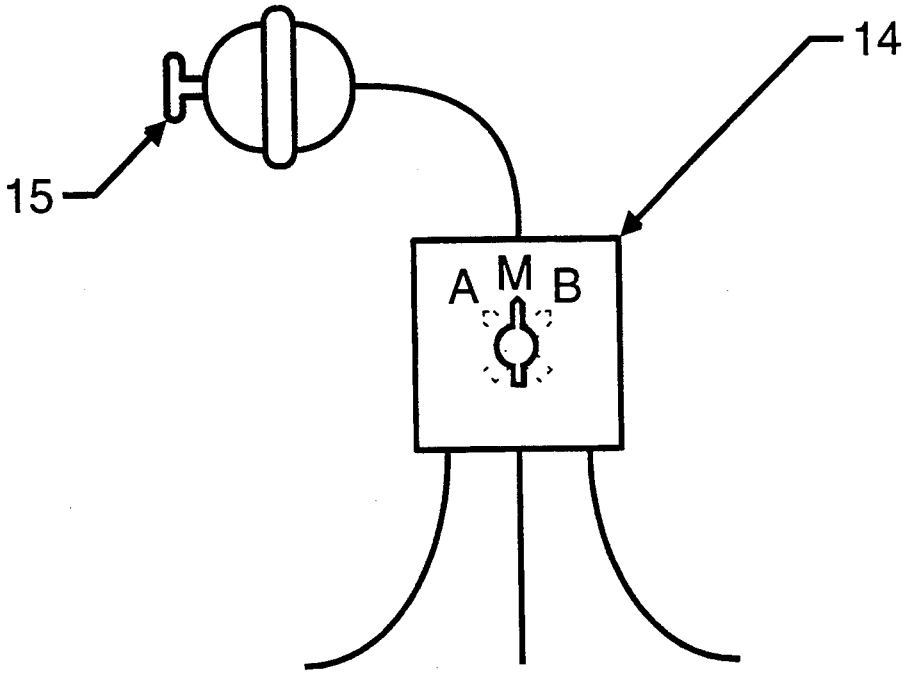
FIG. 4 is a detailed side view of the adjustment valve for selecting the chamber to be expanded/contracted.

FIG. 4 shows adjustment valve 14 in detail. By selecting the desired chamber using adjustment valve 14, each chamber can be expanded or contracted using inflation device 15.

Figure 3:
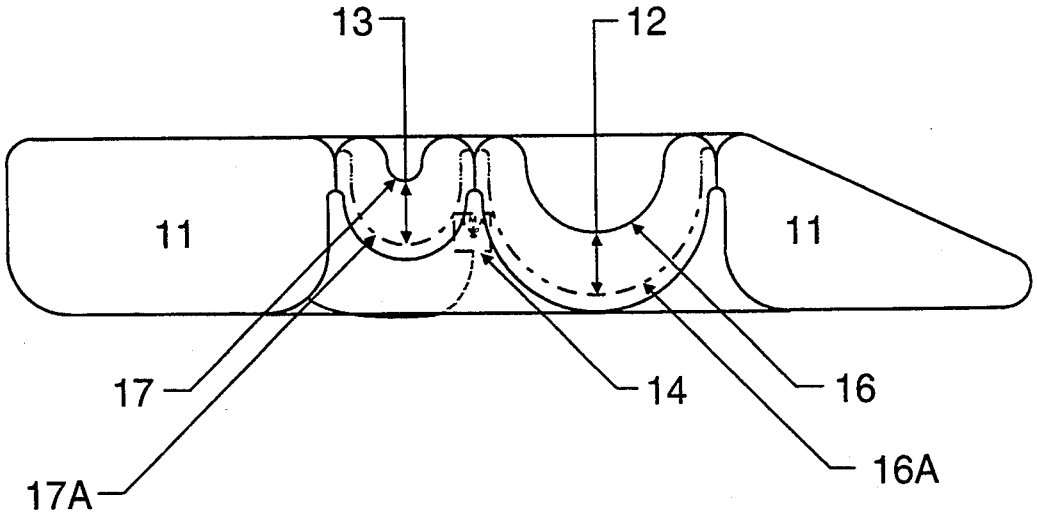
FIG. 3 is a side view, partially in cross section of the support device, showing the adjustable properties of the two receiving chambers for the abdomen and breasts, respectively.

FIG. 3 portrays chambers 12 and 13 in their various stages of expansion, with positions 16, 16A; 17 and 17A not being the only positions of support but rather representing several of the many possible levels of support to which the chambers may be expanded or contracted.

Figure 5:
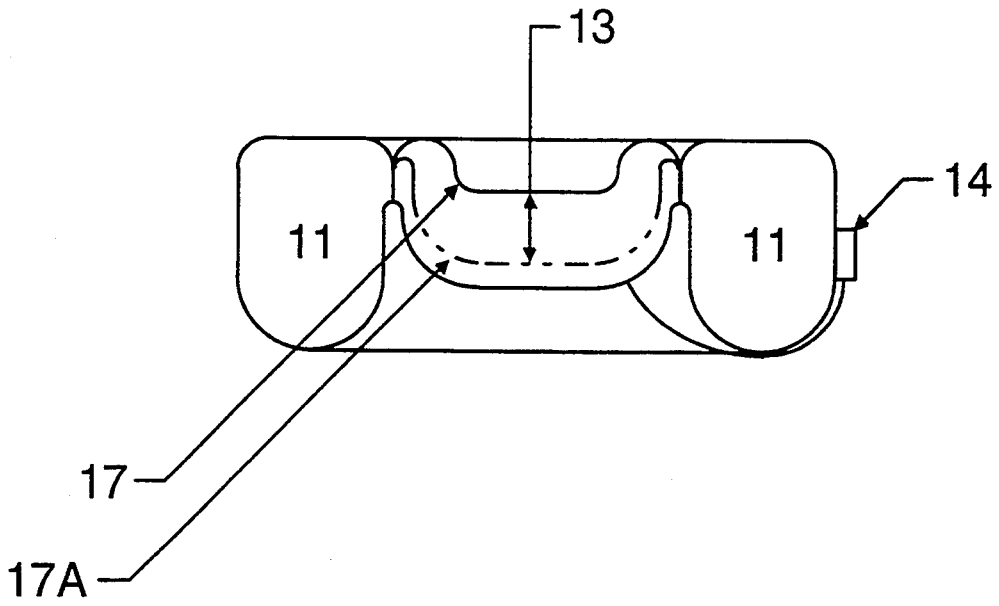
FIG. 5 is an end view, partially in cross section of detailed section B—B, showing the adjustable properties of the receiving chamber for the breasts.

FIG. 5 depicts chamber 13 in various stages of support, with positions 17 and 17A representing two of the many possible levels of support to which the chamber may be expanded. Adjustment valve 14 is shown in FIG. 5 on the right side of chambers 11 and 13.

Figure 6:
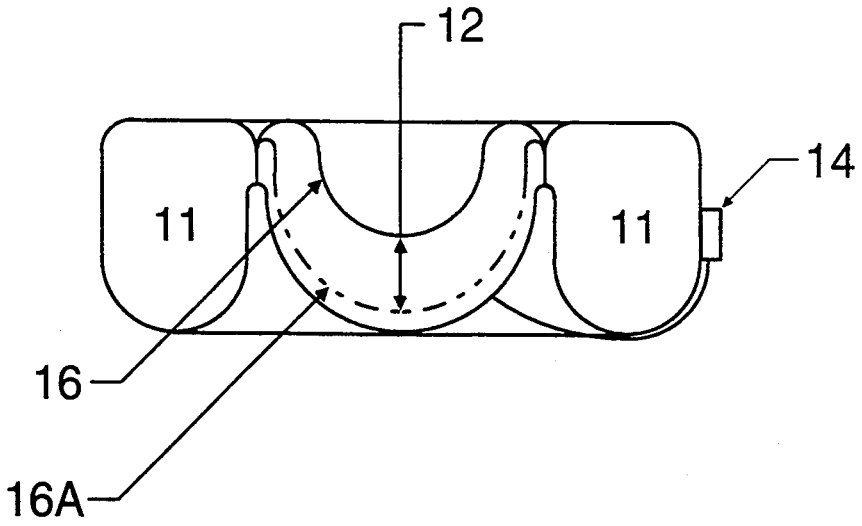
FIG. 6 is an end view, partially in cross section of detailed section C—C, showing the adjustable properties of the receiving chamber for the abdomen.
Figure 7A:
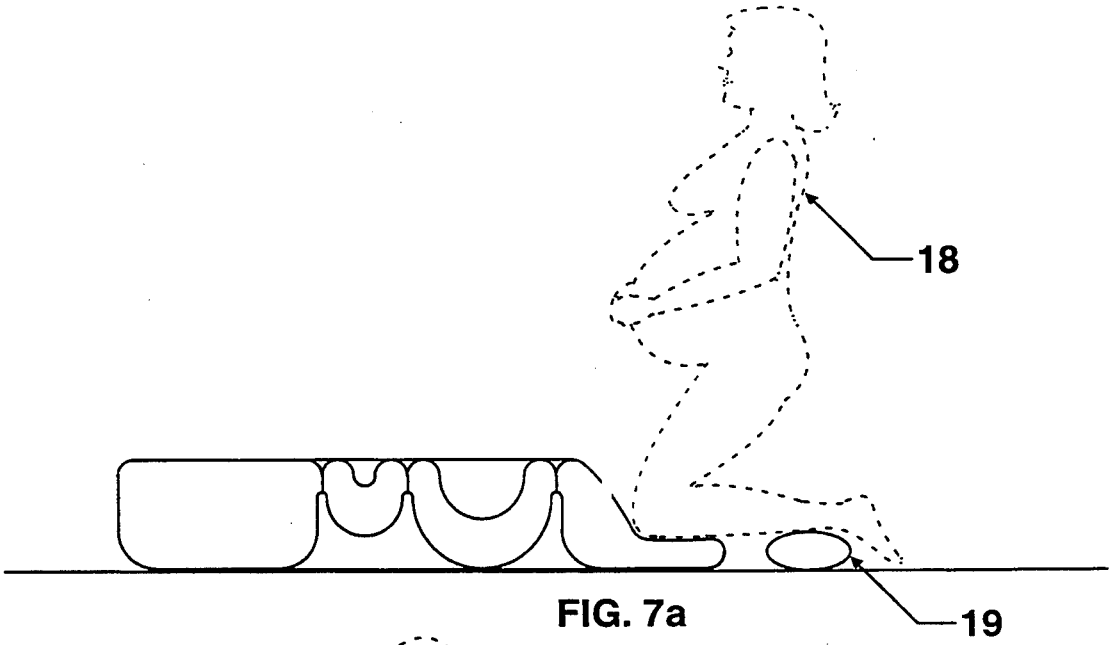
Figure 7B:
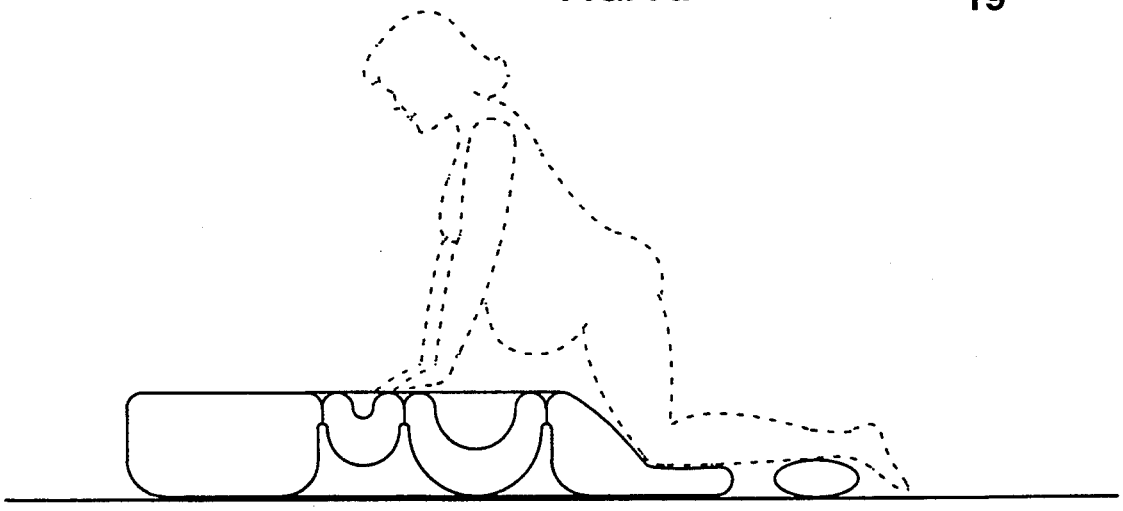
Figure 7C:
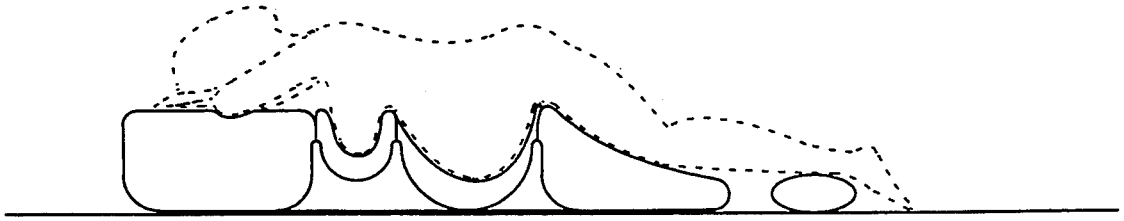

FIG. 6 shows chamber 12 in various stages of support, with positions 16 and 16A representing two of the many possible levels of support to which the chamber may be expanded. Adjustment valve 14 is shown in FIG. 6 on the right side of chambers 11 and 12.

From the descriptions above, a number of advantages of the present invention become evident:

(a) The main mattress body being manufactured of one piece of material avoids the need for a large and costly plant with a multitude of manufacturing equipment. The inflation devices and adjustment valves can be purchased pre-fabricated and ready for attachment to the mattress at time of manufacture.

(b) The integral properties of adjustment within all aspects of the present invention accomodate the majority of physiques of the pregnant female, providing a "one size fits all" model and reducing the costly re-tooling of manufacturing equipment or duplicity of said manufacturing equipment.

(c) As shown in FIG. *7a, 7b, 7c,* the sloped design of chamber 11 allows for a safer entry or exit when the device is used upon a conventional mattress.

(d) Not shown but inherent in the use of such a device would be the use of a specially designed and fitted linen sheet to cover the mattress body, with chambers incorporated into the linen to conform to the chambers of the mattress. The use of such a linen sheet avoids the asthetic need to color the mattress material, thereby eliminating costly coloring pigments and mixing facilities and the inherent toxic dangers that come with the use of such chemicals. In addition, this brings an added level of comfort as the woman will not be in contact with the mattress surface, made of vinyl or other pliable material, but rather on a breathable cotton or other appropriate linen material.

(e) The inflation device 15, in conjuction with adjustment valve 14, allows for total self-adjustment while laying upon the device, eliminating the need to repeatedly get off and on the mattress to adjust the level of support.

(f) The lightweight, compact, and sturdy design allows for easy storage and cleaning as well as repeated use on a conventional mattress or in other appropriate settings.

Operation—FIGS. *7a, 7b, 7c*

The manner of using the maternal support device is similar to that of expandable mattresses in present use. Namely, to use the present invention, one firsts inflates mattress body 11 to the desired level of support using inflation device 15. Next, one kneels at the foot of mattress 10. Leaning forward, one places one hand on either side of mattress 10 and lowers the body onto the device, allowing the abdomen and breasts to enter into chambers 12 and 13, respectively.

Once on the device, one can adjust support in chambers 12 and 13 using inflation device 15 and adjustment valve 14. An additional support device 19 can be used, if desired, by placing, for instance, a pillow or rolled bath towel under the ankles to help support the legs and/or feet.

To exit the device, one places one hand on either side of the mattress 10. Next, using a half push-up motion, one raises the abdomen and breasts out of chambers 12 and 13 and the body off of mattress 10, returning to the kneeling position in front of the device.

Summary, Ramifications, and Scope

Accordingly, the reader will see that the integral properties of the present invention allow for accomodation of the multitudes of different sizes and shapes of the pregnant female body through minute adjustments in expandable pressure of the various chambers. Furthermore, the design of the present invention has additional advantages in that the user can adjust the device without the aid of a second individual, electrical device (pump, etc.), or otherwise getting off and on the mattress many times;

the inclusion of all properties of adjustment into the device itself eliminates the need for removable attachments that could be misplaced or lost and would ultimately raise overall production costs.

there is considerable concern over the potential injury due to the combined height of both the device and the conventional mattress, a problem eliminated by the lower mattress section (from the waist to the knees) being sloped so as to allow a longitudinal (top to bottom) entry or exit;

the ability of the device to accomodate the abdomen and the breasts helps to prevent "swayback", an unnatural curvature of the spine due to the added weight of the pregnancy, by relieving said weight of the pregnancy off of the spine through the inflation of the two chambers.

Although the description above contains many specificities, these should not be construed as limiting the scope of the invention but rather providing illustrations of some of the presently preferred embodiments of this invention. For example, the chambers can have other shapes such as circular, rectangular, etc.; the main mattress can be rigid and non-inflatable or can contain a plurality of inflatable or non-inflatable chambers, or a combination of both; the inflation device can be replaced with other means of manual or mechanical inflation; there can exist a plurality of inflation devices, etc.

Thus the scope of the invention should be determined by the appended claims and their legal equivalents, rather than by the examples given.

We claim:

1. An adjustable mattress, adapted to support a substantial portion, including the breasts, abdomen, hips, thighs and knees of the body of a pregnant female user in a prone position, comprising a generally horizontal upper mattress portion with a first cavity adapted to accomodate the enlarged abdomen of the user and a second, adjustable in size, cavity adapted to accomodate the breasts of the user, and a lower mattress portion adapted to support the thighs and knees of the user, the lower mattress portion having a supporting surface sloping downwardly from the upper mattress portion adjacent the hip supporting area towards the knee supporting area of the lower mattress portion, the downwardly sloped lower mattress portion adapted to support the thighs in a downwardly inclined orientation and to facilitate the getting on or off the mattress by the user.

2. The adjustable mattress of claim 1 wherein said mattress is expandable by an exterior expandable means attached to said mattress.

3. The adjustable mattress of claim 2 wherein said exterior expandable means consists of a hand pump with an integrated adjustable release mechanism connected to said mattress thorough a hose introduced therein.

4. The adjustable mattress of claim 1 wherein the first cavity is adjustable in size.

5. The adjustable mattress of claim 4 wherein the first cavity is defined by an inflatable chamber adapted to be expanded by a hand pump.

6. The adjustable mattress of claim 1, wherein the second cavity is defined by an inflatable chamber adapted to be expanded by a hand pump.

7. The adjustable mattress of claim 1 wherein the mattress is inflatable.

* * * * *